US006092994A

United States Patent [19]

Yamamoto et al.

[11] Patent Number: 6,092,994

[45] Date of Patent: Jul. 25, 2000

[54] LIQUID DELIVERY DEVICE, METHOD OF CONTROLLING SUCH LIQUID DELIVERY DEVICE, AND LIQUID DELIVERY PUMP

[75] Inventors: Shigekazu Yamamoto, Kawasaki; Tetsuma Ikegami, Yokohama; Hiroshi Sobukawa, Fujisawa; Shun-ichi Aiyoshizawa, Tokyo; Toshiharu Nakazawa, Chigasaki; Yoshinori Ojima, Kamakura, all of Japan

[73] Assignees: Ebara Corporation; Ebara Densan Ltd., both of Tokyo, Japan

[21] Appl. No.: 09/014,992

[22] Filed: Jan. 28, 1998

[30] Foreign Application Priority Data

Jan. 31, 1997 [JP] Japan ..... 9-032907
Jan. 21, 1998 [JP] Japan ..... 10-023925

[51] Int. Cl.[7] ..... F04B 23/10; F01C 1/16

[52] U.S. Cl. ..... 417/53; 418/201.3

[58] Field of Search ..... 417/53; 418/48, 418/182, 21, 201.3; 310/191, 254, 209

[56] References Cited

U.S. PATENT DOCUMENTS

| | | | |
|---|---|---|---|
| 3,846,045 | 11/1974 | Mincuzzi | 416/230 |
| 4,591,322 | 5/1986 | Ono et al. | 418/48 |
| 5,046,666 | 9/1991 | Ono | 239/73 |
| 5,527,159 | 6/1996 | Bozeman, Jr. et al. | 417/45 |
| 5,614,777 | 3/1997 | Bitterly et al. | 310/74 |
| 5,674,063 | 10/1997 | Ozaki et al. | 418/201.3 |

FOREIGN PATENT DOCUMENTS

| | | |
|---|---|---|
| 2.165.633 | 8/1976 | France . |
| WO 88/03993 | 6/1988 | WIPO . |
| WO 91/19103 | 12/1991 | WIPO . |

OTHER PUBLICATIONS

Tsuyoshi Asanuma, "Study on the Sealing Action by Viscous Fluid", Institute of Electrostatics Japan, 1951, pp. 119–125.
Tadashi Koga, "Recent topics of Non–contact seal", Yoken–do, Japan, Jul., 1999.
Eimei Akamatsu, "Present status of Magnetic levitated centrifugal blood circulating pump", Institute of Electrostatics, Japan, 1955.
Abstract of Japanese Publication No. 61–266248.
"Fluid Film Supports and Pumps" Eureka—vol. 11, No. 11, Nov. 1, 1991.
Radnor "Instruments & Control System"—vol. 56, No. 1, Jan. 1983, pp. 41–43.

*Primary Examiner*—Henry C. Yuen
*Assistant Examiner*—Mahmoud M. Gimie
*Attorney, Agent, or Firm*—Armstrong, Westerman, Hattori, McLeland & Naughton

[57] ABSTRACT

A screw pump includes a casing having inlet and outlet ports and a pump rotor rotatably mounted in the casing and having screw threads communicating with said inlet and outlet ports. The pump rotor is rotated by a reversible speed-controllable motor, typically a DC brushless motor, mounted in the casing to deliver a liquid such as a chemical solution from the inlet port through a liquid passage defined by the screw threads to the outlet port.

10 Claims, 5 Drawing Sheets

LIQUID DELIVERY DEVICE, METHOD OF CONTROLLING SUCH LIQUID DELIVERY DEVICE, AND LIQUID DELIVERY PUMP

BACKGROUND OF THE INVENTION

1. Field of the Invention

The present invention relates to a liquid delivery device for delivering a special chemical solution such as a resist solution, a wafer protection solution, or the like which will be used in the fabrication of semiconductor devices, a method of controlling such a liquid delivery device, and a liquid delivery pump for delivering such a special chemical solution.

2. Description of the Prior Art one generally known liquid delivery device for delivering a special chemical solution comprises a positive-displacement piston pump disposed in a liquid delivery line which interconnects a liquid supply and a liquid consumption site, for delivering the chemical solution under a predetermined pressure.

The liquid delivery device has a inlet valve placed in an inlet pipe of the liquid delivery line which is connected to an inlet port of the positive-displacement piston pump, and an outlet valve disposed in an outlet pipe of the liquid delivery line which is connected to an outlet port of the positive-displacement piston pump, the inlet and outlet valves being used to prevent the chemical solution from flowing back into the positive-displacement piston pump. The liquid delivery device needs to have a flow regulating valve for regulating the flow rate of the chemical solution.

Another liquid delivery device which is widely used in the art is an in-line pump comprising an integral assembly of a pump and a motor for easy installation in a liquid delivery line. The in-line pump has a main shaft rotatable with an impeller by the motor, the main shaft being rotatably supported by rolling bearings and slide bearings.

The positive-displacement piston pump has been disadvantageous in that the piping system is structurally complex because of the valves that are positioned in the liquid delivery line. If the chemical solution to be delivered contains a solvent, then when the positive-displacement piston pump is shut off after a certain amount of the chemical solution has been delivered, the chemical solution remaining in the outlet pipe is exposed to air at the outlet of the outlet pipe, allowing the solvent to evaporate into the open space. As a result, the chemical solution is solidified at the outlet of the outlet pipe and tends to clog the outlet pipe.

The rolling and slide bearings used in the in-line pump produce fine particles due to frictional contact between sliding members of the rolling and slide bearings. If the in-line pump is employed in the fabrication semiconductor devices, then such fine particles produced by the rolling and slide bearings contaminate the chemical solution delivered by the in-line pump, resulting in a reduction in the quality of semiconductor wafers. During operation of the in-line pump, the chemical solution finds its way into small gaps that were created in the in-line pump when the in-line pump was assembled of various parts. The chemical solution trapped in those small gaps is liable to be degraded and contaminated with time, and impairs the quality of semiconductor wafers. The chemical solution deposits in the gaps become solidified and stick to the pump parts, making the in-line pump difficult to service for maintenance.

SUMMARY OF THE INVENTION

It is therefore an object of the present invention to provide a liquid delivery device which is relatively simple in structure, is effective to minimize solidified deposits of a delivered liquid in a liquid delivery line, is effective to prevent the generation of particles, and is structured to eliminate stagnant and dead liquid regions therein.

Another object of the present invention is to provide a method of controlling such a liquid delivery device.

Still another object of the present invention is to provide a liquid delivery pump for use as such a liquid delivery device.

According to an aspect of the present invention, there is provided a liquid delivery device for use in a liquid delivery line for delivering a liquid. The liquid delivery device includes a screw pump including a casing having inlet and outlet ports and a pump rotor rotatably mounted in said casing and having screw threads communicating with said inlet and outlet ports, and a reversible speed-controllable motor mounted in said casing for rotating said pump rotor to deliver the liquid from said inlet port through said screw threads to said outlet port. By controlling the rotational speed and direction of rotation of the screw pump, the liquid can be sucked back from the outlet port into the inlet port after a predetermined amount of the liquid has been delivered from the inlet port to the outlet port. The liquid is thus prevented from remaining in the outlet port or inside of the pump. Also, the liquid can be stopped from flowing by the screw pump itself without the need for check valves.

The reversible speed-controllable motor comprises a DC brushless motor, and said pump rotor is rotatably supported in a bearing-free environment by the liquid as a lubricant. The DC brushless motor makes it possible to control the rotation of the pump rotor with ease. As the pump rotor is rotatably supported by the liquid without the need for bearings, the liquid is prevented from being contaminated by a lubricant or fine particles which would otherwise be produced by frictional contact between sliding surfaces.

According to another aspect of the present invention, there is provided a method of controlling a liquid delivery device including a casing having inlet and outlet ports adapted to be connected to inlet and outlet pipes, respectively, a screw pump including a pump rotor rotatably mounted in said casing and having screw threads communicating with said inlet and outlet ports, and a reversible speed-controllable motor mounted in said casing for rotating said pump rotor to deliver the liquid from said inlet port through said screw threads to said outlet port. The method comprises the steps of energizing said reversible speed-controllable motor to rotate said pump rotor to deliver a predetermined amount of liquid from said inlet pipe through said inlet port, said screw threads, and said outlet port into said outlet pipe, and thereafter, controlling said reversible speed-controllable motor to rotate said pump rotor for sucking back an amount of liquid remaining in said outlet pipe from said outlet port through said screw threads and said inlet port into said inlet pipe. Because the liquid is sucked back from the outlet pipe, the liquid is prevented from remaining in the outlet pipe and hence from being solidified in and clogging the outlet pipe.

After the step of energizing said reversible speed-controllable motor to rotate said pump rotor to deliver a predetermined amount of liquid from said inlet pipe through said inlet port, said screw threads, and said outlet port into said outlet pipe, the reversible speed-controllable motor may be controlled to enable said screw pump to function as a valve for stopping the liquid from flowing from said inlet pipe through said inlet port, said screw threads, and said outlet port into said outlet pipe. The liquid delivery device thus controlled may be relatively simple in structure as it requires no stop valves.

Alternatively, after the step of energizing said reversible speed-controllable motor to rotate said pump rotor to deliver a predetermined amount of liquid from said inlet pipe through said inlet port, said screw threads, and said outlet port into said outlet pipe, said reversible speed-controllable motor may be controlled to enable said screw pump to function as a valve for regulating a rate at which the liquid flows from said inlet pipe through said inlet port, said screw threads, and said outlet port into said outlet pipe. The liquid delivery device thus controlled may be relatively simple in structure as it requires no flow regulating valves.

According to still another aspect of the present invention, there is provided a screw pump for delivering a liquid, comprising a casing having inlet and outlet ports, a pump stator mounted in said casing, a pump rotor rotatably mounted in said pump stator and having screw threads defined in a circumferential surface thereof and communicating with said inlet and outlet ports, a motor for rotating said pump rotor to deliver a liquid from said inlet port through said screw threads into said outlet port, said motor having a motor rotor disposed in said pump rotor and a motor stator disposed around said pump rotor, a plurality of radial magnetic bearings, said pump rotor having respective opposite ends rotatably supported by said radial magnetic bearings, and at least one axial magnetic bearing, at least one of said opposite ends of said pump rotor being rotatably supported by said at least one axial magnetic bearing. Since the pump rotor is magnetically levitated out of contact with surrounding parts, the pump rotor can be rotated stably and do not produce fine particles which would otherwise be generated by frictional contact between rotating and stationary parts and would otherwise contaminate the liquid.

The pump stator and said pump rotor have surfaces made of or coated with a water-repellent material, for contact with the liquid. The surfaces of or coated with the water-repellent material repel the liquid being delivered and prevent the liquid from being trapped in gaps between the pump stator and the pump rotor. The water-repellent material makes the surfaces chemically stable against erosion by the liquid, which may typically be a chemical solution.

The inlet port, a liquid passage defined by said screw threads, and the outlet port are arranged substantially linearly. The substantially linear pattern of the inlet port, the liquid passage defined by said screw threads, and the outlet port is effective to eliminate stagnant and dead liquid regions in the screw pump.

The screw pump further comprises a pair of guide members disposed respectively in said inlet and outlet ports. Each of said guide members has a substantially conical shape including a spherical head facing outwardly and a progressively radially outwardly spreading proximal end. The guide members define liquid passages in said inlet and outlet ports, which smoothly blend into said liquid passage defined by said screw threads. With this arrangement, the liquid can be delivered smoothly from the inlet port to the outlet port without stagnant and dead liquid regions created between the inlet port and the outlet port.

The inlet and outlet ports are symmetrical in structure with respect to said pump rotor for allowing the liquid to be delivered easily in one direction or the other through the screw pump.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
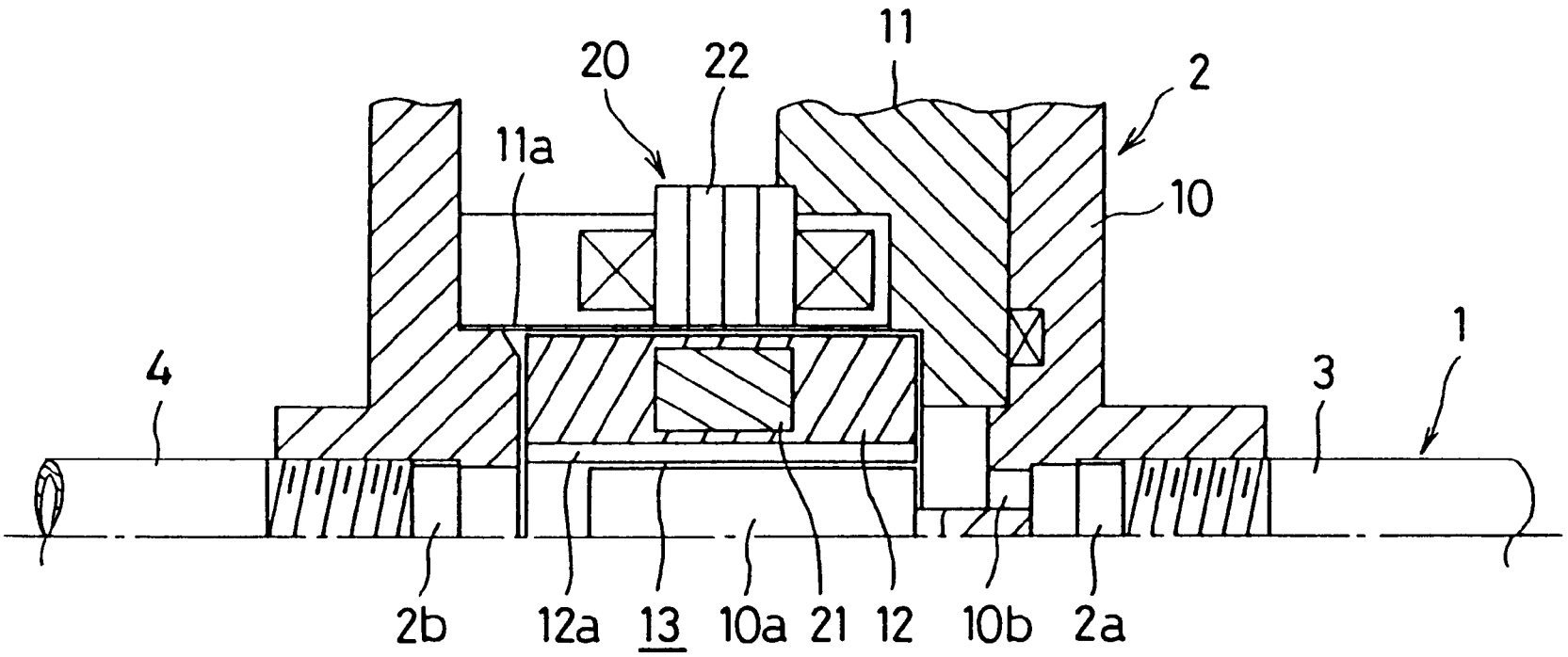
FIG. 1 is a fragmentary cross-sectional view of a screw pump as a liquid delivery device according to a first embodiment of the present invention.

As shown in FIG. 1, a screw pump 2 as a liquid delivery device according to a first embodiment of the present invention is disposed in series in a liquid delivery line 1 which interconnects a liquid supply and a liquid consumption site. The screw pump 2 has an inlet port 2*a* connected to an inlet pipe 3 of the liquid delivery line 1 and an outlet port 2*b* connected to an outlet pipe 4 of the liquid delivery line 1. The screw pump 2 has a central axis of rotation aligned with and contiguous to the central axes of the inlet and outlet pipes 3, 4.

The screw pump 2 primarily comprises a casing 10, a pump stator 11 housed in the casing 10 and having a cylindrical can 11*a*, and a cylindrical pump rotor 12 rotatably disposed in the can 11*a* and having screw threads 12*a* defined in an inner circumferential surface thereof. The casing 10 includes an integral cylindrical shank 10*a* whose axis is aligned with the central axes of the inlet and outlet ports 2*a*, 2*b*. The casing 10 also has through holes 10*b* defined around an end of the shank 10*a*. The pump rotor 12 is disposed around the shank 10*a*, and the can 11*a* is disposed around the pump rotor 12.

When the pump rotor 12 rotates about its own axis in one direction, a liquid drawn from the inlet pipe 3 through the inlet port 2*a* flows through the through holes 10*b* and then through a gap 13 defined between the shank 10*a* and the stator can 11*a* along the screw threads 12*a*, during which time the liquid is compressed to a predetermined pressure by the screw threads 12*a*. Thereafter, the liquid is discharged from the outlet port 2*b* into the outlet pipe 4.

The screw pump 2 also has a reversible speed-controllable DC brushless motor 20 for rotating the pump rotor 12. The DC brushless motor 20 comprises a motor rotor 21 in the form of magnets embedded in the pump rotor 12 and a motor stator 22 mounted in the pump stator 11 circumferentially around the can 11*a* for rotating the motor rotor 21.

Since the pump rotor 12 is rotated by the DC brushless motor 20, the direction of rotation and the rotational speed of the pump rotor 12 can easily be controlled by a motor driver (not shown) which supplies a current to coils of the motor stator 22. The pump rotor 12 is rotatably supported in a bearing-free environment by the liquid that flows through the gap 13. The liquid that flows through the gap 13 also acts as a lubricant flowing around the pump rotor 12. Therefore, the liquid that is delivered by the screw pump 2 is prevented from being contaminated by a lubricant which would otherwise be separately required in the screw pump 2.

A process of controlling the screw pump 2 will be described below.

For delivering the liquid under a predetermined pressure from the outlet port 2*b* of the screw pump 2, the pump rotor 12 is rotated at a predetermined rotational speed in one direction, i.e., in a direction for the screw threads 12*a* to feed the liquid in a helical flow pattern from the inlet port 2*a* to the outlet port 2*b*.

After a desired amount of the liquid has been delivered from the pump 2, the pump rotor 12 is reversed in rotation, i.e., rotated in the opposite direction, or is rotated at a reduced rotational speed, to suck back the liquid remaining in the outlet pipe 4 into the inlet pipe 3.

Specifically, if the liquid will not flow back due to the differential pressure between the inlet and outlet ports 2*a*, 2*b* when the pump rotor 12 is stopped, then the pump rotor 12 is rotated in the opposite direction to suck back the liquid remaining in the outlet pipe 4 into the inlet pipe 3. Conversely, if the liquid pressure in the outlet port 2*b* is large enough for the liquid to flow back due to the differential pressure between the inlet and outlet ports 2*a*, 2*b* when the pump rotor 12 is stopped, then the rotational speed of the pump rotor 12 is reduced to suck back the liquid remaining in the outlet pipe 4 into the inlet pipe 3.

Inasmuch as the liquid remaining in the outlet pipe 4 is sucked back into the inlet pipe 3, even if the liquid is a chemical solution that can easily be solidified, the liquid is prevented from being solidified in the outlet of the outlet pipe 4 and clogging the outlet pipe 4.

After the liquid remaining in the outlet pipe 4 has been sucked back into the inlet pipe 3 by reversing the pump rotor 12, the rotational speed of the pump rotor 12 is reduced to a level matching the pressure in the inlet port 2*a*. After the liquid remaining in the outlet pipe 4 has been sucked back into the inlet pipe 3 by reducing the rotational speed of the pump rotor 12, the rotational speed of the pump rotor 12 is increased to stop the liquid from flowing back. The screw pump 2 thus functions as a valve for stopping the delivery of the liquid or regulating the rate of flow of the liquid.

Accordingly, the screw pump 2 itself is capable of controlling the flow of the liquid without the use of check valves, on-off valves, and flow regulating valves. As a result, the liquid delivery device according to the first embodiment is relatively simple in structure.

Figure 2:
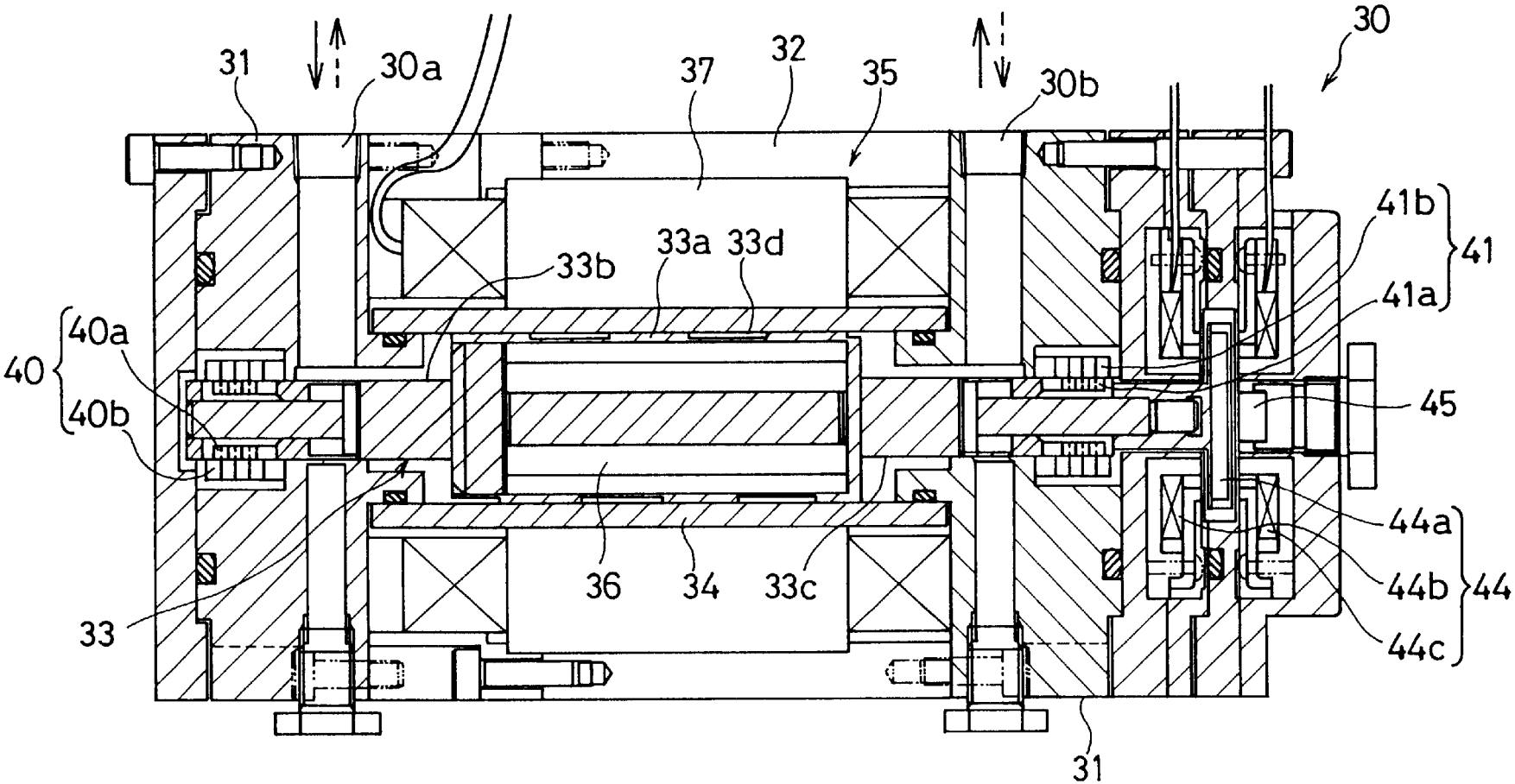
FIG. 2 is a cross-sectional view of a screw pump as a liquid delivery device according to a second embodiment of the present invention.

FIG. 2 shows a screw pump 30 as a liquid delivery device according to a second embodiment of the present invention. As shown in FIG. 2, the screw pump 30 comprises a pair of casings 31 having an inlet port 30*a* and an outlet port 30*b*, respectively, which are connected respectively to inlet and outlet pipes similar to the inlet and outlet pipes 3, 4 shown in FIG. 1. The screw pump 30 has a pump stator 32 disposed between and fixed to the casings 31 and a pump rotor (main shaft) 33 rotatably disposed in the pump stator 32.

The pump rotor 33 primarily comprises a central large-diameter member 33*a* and a pair of shafts 33*b*, 33*c* connected respectively to axially opposite ends of the central large-diameter member 33*a*. The central large-diameter member 33*a* has screw threads 33*d* defined in an outer circumferential surface thereof. A thin inner cylinder 34 is disposed between and secured to the casings 31 in surrounding relation to the central large-diameter member 33*a*.

The screw pump 30 has a reversible speed-controllable DC brushless motor 35 for rotating the pump rotor 33. The DC brushless motor 35 comprises a motor rotor 36 in the form of magnets embedded in the central large-diameter member 33*a* and an electromagnet assembly 37 mounted in the pump stator 32 and comprising electromagnets spaced circumferentially around the inner cylinder 34 for rotating the motor rotor 36. When the pump rotor 33 is rotated by the DC brushless motor 35, the screw threads 33*a* are rotated to deliver a liquid, such as a chemical solution, from the inlet port 30*a* through a gap between the inner cylinder 34 and the large diameter member 33*a* of the pump rotor 33 along the screw threads 33*a*.

Major parts of the screw pump 30 are made of a water-repellent material such as fluoroplastics. At least those portions of the screw pump 30 which will contact the liquid in the gap between the movable and stationary parts are made of fluoroplastics or a material coated with fluoroplastics and hence have no exposed metal or the like on their surfaces.

Radial magnetic bearings 40, 41, which are mounted in the respective casings 31, have respective rotor poles 40*a*, 41*a* fixed respectively to the shafts 33*b*, 33*c* and respective stator poles 40*b*, 41*b* fixed to the casings 31 at their portions radially confronting the rotor poles 40*a*, 41*a*. The rotor poles 40*a*, 41*a* and the stator poles 40*b*, 41*b* comprise permanent magnets, respectively. The rotor poles 40*a*, 41*a* and the stator poles 40*b*, 41*b* which radially confront each other have like polarity and produce repulsive forces to support the pump rotor 33 out of contact with the casings 31. The rotor poles 40*a*, 41*a* and the stator poles 40*b*, 41*b* have surfaces coated with fluoroplastics for repelling the chemical solution being delivered by the screw pump 30 and also keeping themselves chemically stable with respect to the chemical solution.

A controllable axial magnetic bearing 44 is mounted on one of the casings 31 which is adjacent to the radial magnetic bearing 41. The axial magnetic bearing 44 has a target disk 44*a* and a pair of electromagnets 44*b*, 44*c*. The target disk 44*a* is positioned axially opposite to the opposite surfaces of the electromagnets 44*b* 44*c*. An axial sensor 45 is disposed in axially facing relation to the outer surface of the target disk 44*a*. The target disk 44*a* and the electromagnets 44*b*, 44*c* have surfaces coated with fluoroplastics for chemical stability with respect to the chemical solution.

Radial forces acting on the pump rotor 33 are borne by the radial magnetic bearings 40, 41, whereas axial thrust forces acting on the pump rotor 33 are borne by the axial magnetic bearing 44, for thereby holding the pump rotor 33 in a magnetically levitated condition out of contact with the surrounding stationary parts including the inner cylinder 34 and the casings 31.

Because the pump rotor 33 is magnetically levitated out of contact with the surrounding stationary parts by the radial magnetic bearings 40, 41 and the axial magnetic bearing 44, the pump rotor 33 can be rotated stably and does not produce fine particles which would otherwise contaminate the liquid or chemical solution being delivered by the screw pump 30. Since the surfaces of the parts which are held in contact with the liquid are made of fluoroplastics or coated with fluoroplastics, those surfaces repel the chemical solution and are chemically stable as they are resistant to erosion by the chemical solution.

The screw pump 30 according to the second embodiment is controlled in the same manner as with the screw pump 2 shown in FIG. 1 for controlling the flow of the liquid without the use of check valves, on-off valves, and flow regulating valves.

Figure 3:
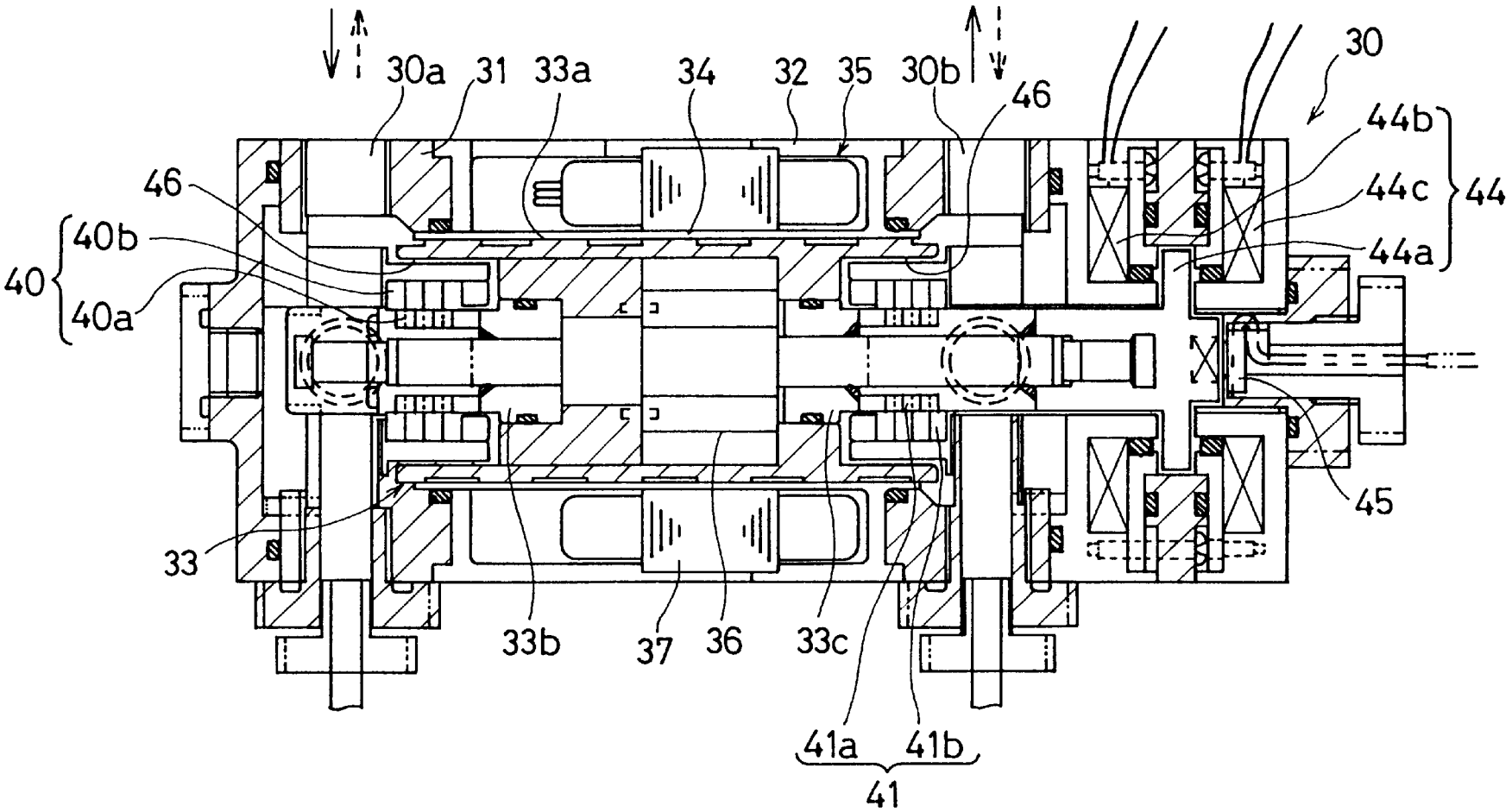
FIG. 3 is a cross-sectional view of a modification of the screw pump shown in FIG. 2.

FIG. 3 shows a modification of the screw pump 30 shown in FIG. 2. Those parts shown in FIG. 3 which are identical to those shown in FIG. 2 are denoted by identical reference characters. The modified screw pump 30 shown in FIG. 3 differs from the screw pump 30 shown in FIG. 2 in that the large-diameter member 33*a* of the pump rotor 33 has recesses 46 defined in the respective axially opposite ends thereof, and the radial magnetic bearings 40, 41 are disposed respectively in the recesses 46. The can 34, which is thinner than the can 34 shown in FIG. 3, is integral with the pump stator 32, and the inlet port 30*a*, a liquid passage defined by the screw threads 33*d*, and the outlet port 30*b* are arranged substantially linearly. The modified screw pump 30 shown in FIG. 3 is relatively small and compact, and has less stagnant and dead liquid regions therein.

Figure 4:
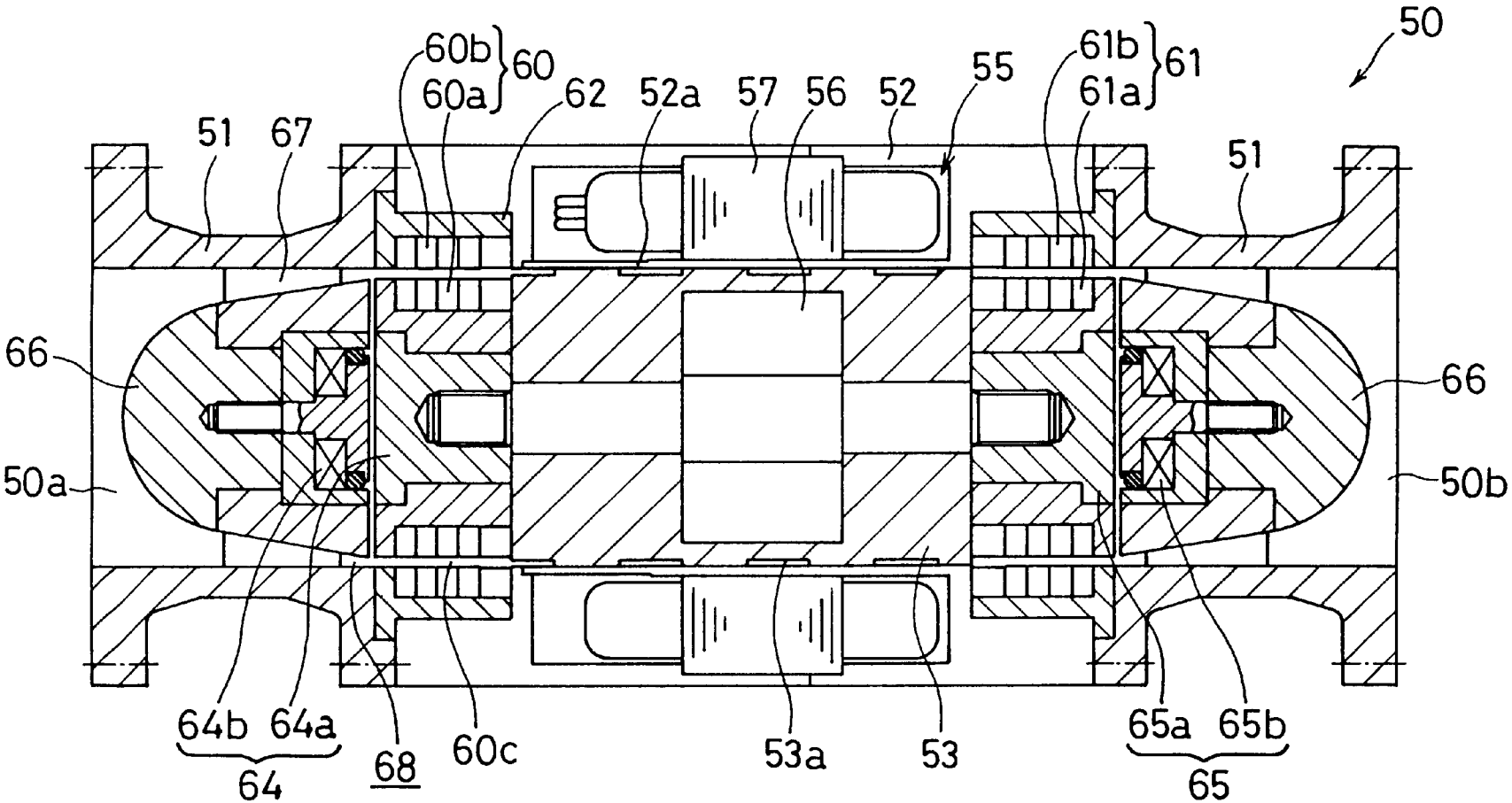
FIG. 4 is a cross-sectional view of a screw pump as a liquid delivery device according to a third embodiment of the present invention.

FIG. 4 shows a screw pump 50 as a liquid delivery device according to a third embodiment of the present invention. The screw pump 50 comprises a pair of casings 51 having an inlet port 50*a* and an outlet port 50*b*, respectively, which are connected respectively to inlet and outlet pipes similar to the inlet and outlet pipes 3, 4 shown in FIG. 1. The screw pump 50 has a pump stator 52 disposed in series between and fixed to the casings 51 and a pump rotor (main shaft) 53 rotatably disposed in the pump stator 52.

A cylindrical can 52*a* is fixed to an inner circumferential surface of the pump stator 52, and the pump rotor 53 has screw threads 53*a* defined in an outer circumferential surface thereof which radially faces the can 52*a*. The outer circumferential surface of the pump rotor 53 may be made of fluoroplastics, and the screw threads 53*a* may be defined in the surface of fluoroplastics. Alternatively, the outer circumferential surface of the pump rotor 53 may comprise a layer of metal, and the screw threads 53*a* may be defined in the layer of metal, with metal surfaces for contact with the liquid to be delivered being coated with fluoroplastics. According to the third embodiment, major parts of the screw pump 50 are made of fluoroplastics, and metal surfaces for contact with the liquid to be delivered are coated with fluoroplastics.

The screw pump 50 has a reversible speed-controllable DC brushless motor 55 for rotating the pump rotor 53. The DC brushless motor 55 comprises a motor rotor 56 in the form of magnets embedded in the pump rotor 53 and an electromagnet assembly 57 mounted in the pump stator 52 and comprising electromagnets spaced circumferentially around the can 52*a* for rotating the motor rotor 56. When the pump rotor 53 is rotated by the DC brushless motor 55, the screw threads 53*a* are rotated to deliver a liquid, such as a chemical solution, from the inlet port 50*a* through a gap between the can 52*a* and the pump rotor 53 along the screw threads 53*a*.

Radial magnetic bearings 60, 61, which are mounted in the respective casings 51, have respective rotor poles 60*a*, 61*a* fixed respectively to the axially opposite ends of the pump rotor 53 and respective stator poles 60*b*, 61*b* fixed to inner circumferential surfaces of sleeves 62 secured respectively to the casings 51 at their portions radially confronting the rotor poles 60*a*, 61*a*. The rotor poles 60*a*, 61*a* and the stator poles 60*b*, 61*b* comprise permanent magnets, respectively, for magnetically supporting the pump rotor 53 in radial directions under magnetically repulsive forces. The rotor poles 60*a*, 61*a* and the stator poles 60*b*, 61*b* have surfaces coated with fluoroplastics for repelling the chemical solution being delivered by the screw pump 50 and also keeping themselves chemically stable with respect to the chemical solution.

Axial magnetic bearings 64, 65, which are mounted respectively in the casings 51, have respective target disks 64*a*, 65*a* positioned coaxially with the radial magnetic bearings 60, 61 and respective electromagnets 64*b*, 65*b* positioned axially opposite to the outer surfaces of the target disks 64*a*, 65*a*.

Radial forces acting on the pump rotor 53 are borne by the radial magnetic bearings 60, 61, whereas axial thrust forces acting on the pump rotor 53 are borne by the axial magnetic bearings 64, 65, for thereby holding the pump rotor 53 in a magnetically levitated condition out of contact with the surrounding stationary parts including the can 52*a* and the casings 51.

Because the pump rotor 53 is magnetically levitated out of contact with the surrounding stationary parts by the radial magnetic bearings 60, 61 and the axial magnetic bearings 64, 65, the pump rotor 53 can be rotated stably and does not produce fine particles which would otherwise contaminate the liquid or chemical solution being delivered by the screw pump 50.

In the third embodiment, the axial magnetic bearings 64, 65 are supported by respective guide members 66 which are disposed respectively in the inlet and outlet ports 50*a*, 50*b* and supported in the casings 51 by support legs 67. The guide members 66, which are of a substantially conical shape, have spherical heads facing outwardly in the inlet and outlet ports 50*a*, 50*b* and progressively radially outwardly spreading proximal ends located near the radial magnetic bearings 60, 61, respectively. The guide members 66 define axially linear liquid passages 68 in the inlet and outlet ports 50*a*, 50*b*, which smoothly blend into gaps 60*c* defined between the rotor poles 60*a*, 61*a* and the stator poles 60*b*, 61*b* of the radial magnetic bearings 60, 61 and a liquid passage defined by the screw threads 53*a*. As described above, the liquid passage defined by the screw threads 53*a* are bounded by surfaces of fluoroplastics. Since the liquid passages 68 in the inlet and outlet ports 50*a*, 50*b* smoothly blend into the gaps 60*c* and the liquid passage defined by the screw threads 53*a*, the screw pump 50 is free of stagnant and dead liquid regions therein.

With the screw pump 50 according to the third embodiment, the inlet and outlet ports 50*a*, 50*b* are symmetrical in structure with respect to a substantially central position in the pump rotor 53 disposed axially between the inlet and outlet ports 50*a*, 50*b*. The symmetrical nature of the screw pump 50 allows the inlet ports 50*a*, 50*b* to change their function, i.e., to serve as outlet and inlet ports, respectively, when the pump rotor 53 is reversed in rotation. Consequently, the direction in which the liquid or chemical solution flows through the screw pump 50 can be changed easily by changing the direction in which the pump rotor 53 is rotated.

Figure 5:
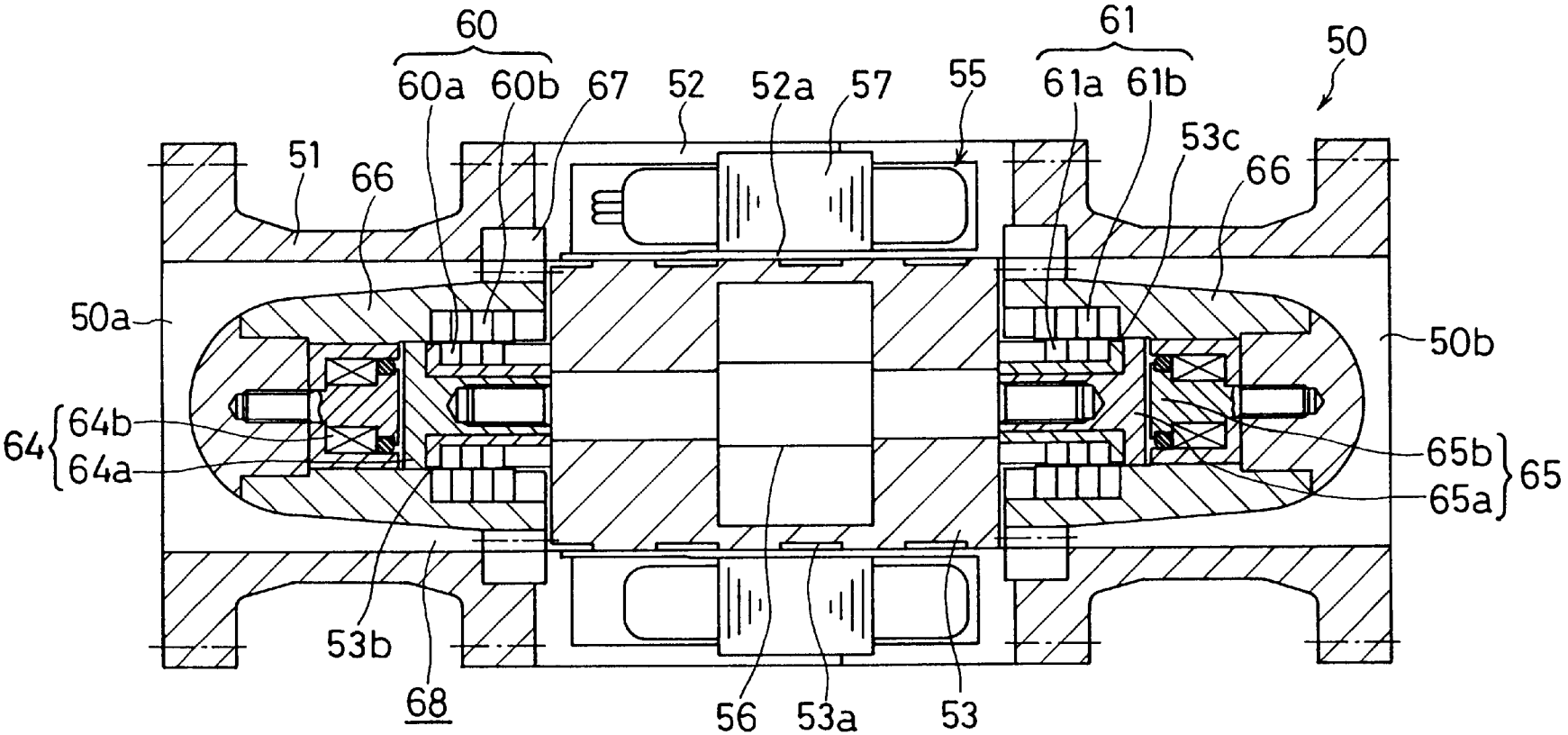
FIG. 5 a cross-sectional view of a modification of the screw pump shown in FIG. 4.

FIG. 5 shows a modification of the screw pump 50 shown in FIG. 4. Those parts shown in FIG. 5 which are identical to those shown in FIG. 4 are denoted by identical reference characters. The modified screw pump 50 shown in FIG. 5 differs from the screw pump 50 shown in FIG. 4 in that shafts 53*b*, 53*c* are coaxially joined to respective axially opposite ends of the pump rotor 53 and disposed respectively in the proximal end portions of the guide members 66. The rotor poles 60*a*, 61*a* of the radial magnetic bearings 60, 61 are fixedly mounted in outer circumferential surfaces of the shafts 53*b*, 53*c*, respectively, and the stator poles 60*b*, 61*b* of the radial magnetic bearings 60, 61 are fixedly mounted in inner circumferential surfaces of the guide members 66 in radially confronting relation to the rotor poles 60*a*, 61*a*. The target disks 64*a*, 65*a* of the axial magnetic bearings 64, 65 are mounted on outer ends of the respective shafts 53*b*, 53*c*, and the electromagnets 64*b*, 65*b* of the axial magnetic bearings 64, 65 are disposed in the guide members 66 in axially confronting relation to the target disks 64*a*, 65*a*.

With the modification shown in FIG. 5, the liquid being delivered by the screw pump 50 does not flow through the gaps between the rotor poles 60*a*, 61*a* and the stator poles 60*b*, 61*b* of the radial magnetic bearings 60, 61, but flows directly from the inlet port 50*a* into the gap between the can 52*a* and the pump rotor 53 and directly from the gap into the outlet port 50*b*. The modified screw pump 50 shown in FIG. 5 is relatively small and compact, has less stagnant and dead liquid regions therein, and can operate highly efficiently because of direct connection between the gap and the inlet or outlet port.

In the illustrated embodiments, the major parts of the screw pump are made of or coated with a water-repellent material such as fluoroplastics. Alternatively, the major parts of the screw pump may be lined with a water-repellent material such as fluoroplastics or covered with a film of such a water-repellent material.

While the DC brushless motor has been described and illustrated as a motor for rotating the pump rotor in the illustrated embodiments, the pump rotor may be rotated by a reluctance-type motor or an induction motor, which may be controlled in speed by an inverter device or the like.

Although certain preferred embodiments of the present invention have been shown and described in detail, it should be understood that various changes and modifications may be made therein without departing from the scope of the appended claims.

What is claimed is:

1. A liquid delivery device for use in a liquid delivery line for delivering a liquid, comprising:

a screw pump including a casing having inlet and outlet ports and a pump rotor rotatably mounted in said casing and having screw threads communicating with said inlet and outlet ports; and a reversible speed-controllable motor mounted in said casing for rotating said pump rotor to deliver the liquid from said inlet port through said screw threads to said outlet port, wherein said reversible speed-controllable motor rotates said pump rotor based on a differential pressure between said inlet and outlet ports.

2. A liquid delivery device according to claim 1, wherein said reversible speed-controllable motor comprises a DC brushless motor, and said pump rotor is rotatably supported in a bearing-free environment by the liquid as a lubricant.

3. A method of controlling a liquid delivery device including a casing having inlet and outlet ports adapted to be connected to inlet and outlet pipes, respectively, a screw pump including a pump rotor rotatably mounted in said casing and having screw threads communicating with said inlet and outlet ports, and a reversible speed-controllable motor mounted in said casing for rotating said pump rotor to deliver the liquid from said inlet port through said screw threads to said outlet port, said method comprising:

energizing said reversible speed-controllable motor to rotate said pump rotor to deliver an amount of liquid from said inlet pipe through said inlet port, said screw threads, and said outlet port into said outlet pipe; and thereafter, controlling said reversible speed-controllable motor to rotate said pump rotor for sucking back an amount of liquid remaining in said outlet pipe from said outlet port through said screw threads and said inlet port into said inlet pipe.

4. A method of controlling a liquid delivery device including a casing having inlet and outlet ports adapted to be connected to inlet and outlet pipes, respectively, a screw pump including a pump rotor rotatably mounted in said casing and having screw threads communicating with said inlet and outlet ports, and a reversible speed-controllable motor mounted in said casing for rotating said pump rotor to deliver the liquid from said inlet port through said screw threads to said outlet port, said method comprising:

energizing said reversible speed-controllable motor to rotate said pump rotor to deliver an amount of liquid from said inlet pipe through said inlet port, said screw threads, and said outlet port into said outlet pipe; and thereafter, controlling said reversible speed-controllable motor to enable said screw pump to function as a valve for stopping the liquid from flowing from said inlet pipe through said inlet port, said screw threads, and said outlet port into said outlet pipe.

5. A method of controlling a liquid delivery device including a casing having inlet and outlet ports adapted to be connected to inlet and outlet pipes, respectively, a screw pump including a pump rotor rotatably mounted in said casing and having screw threads communicating with said inlet and outlet ports, and a reversible speed-controllable motor mounted in said casing for rotating said pump rotor to deliver the liquid from said inlet port through said screw threads to said outlet port, said method comprising:

energizing said reversible speed-controllable motor to rotate said pump rotor to deliver an amount of liquid from said inlet pipe through said inlet port, said screw threads, and said outlet port into said outlet pipe; and thereafter, controlling said reversible speed-controllable motor to enable said screw pump to function as a valve for regulating a rate at which the liquid flows from said inlet pipe through said inlet port, said screw threads, and said outlet port into said outlet pipe.

6. A screw pump for delivering a liquid, comprising:

a casing having inlet and outlet ports;

a pump stator mounted in said casing;

a pump rotor rotatably mounted in said pump stator and having screw threads defined in a circumferential surface thereof and communicating with said inlet and outlet ports;

a motor for rotating, based on a differential pressure between said inlet and outlet ports, said pump rotor to deliver a liquid from said inlet port through said screw threads into said outlet port, said motor having a motor rotor disposed in said pump rotor and a motor stator disposed around said pump rotor;

a plurality of radial magnetic bearings, said pump rotor having respective opposite ends rotatably supported by said radial magnetic bearings; and at least one axial magnetic bearing, at least one of said opposite ends of said pump rotor being rotatably supported by said at least one axial magnetic bearing.

7. A screw pump according to claim 6, wherein said pump stator and said pump rotor have surfaces made of or coated with a water-repellent material, for contact with the liquid.

8. A screw pump according to claim 6, wherein said inlet port, a liquid passage defined by said screw threads, and said outlet port are arranged substantially linearly.

9. A screw pump according to claim 8, further comprising a pair of guide members disposed respectively in said inlet and outlet ports, each of said guide members having a substantially conical shape including a spherical head facing outwardly and a progressively radially outwardly spreading proximal end, said guide members defining liquid passages in said inlet and outlet ports, which smoothly blend into said liquid passage defined by said screw threads.

10. A screw pump according to claim 9, wherein said inlet and outlet ports are symmetrical in structure with respect to said pump rotor.

* * * * *